US006409358B1

(12) United States Patent
Grover

(10) Patent No.: US 6,409,358 B1
(45) Date of Patent: Jun. 25, 2002

(54) ILLUMINATED STOP SIGN

(76) Inventor: Michael W. Grover, 391-D N. Melrose Dr., Vista, CA (US) 92083

( * ) Notice: Subject to any disclaimer, the term of this patent is extended or adjusted under 35 U.S.C. 154(b) by 0 days.

(21) Appl. No.: 09/612,088

(22) Filed: Jul. 7, 2000

(51) Int. Cl.[7] ..... F21V 33/00

(52) U.S. Cl. ..... 362/109; 362/186; 362/208; 362/812; 40/555

(58) Field of Search ..... 362/812, 109, 362/186, 208; 340/815.53, 815.55, 815.74; 40/555, 572

(56) References Cited

U.S. PATENT DOCUMENTS 1,445,483 A 2/1923 Burke
3,279,110 A 10/1966 Lelicoff
3,810,091 A 5/1974 Hoover
3,821,860 A * 7/1974 Patty ..... 40/129
4,042,919 A 8/1977 Patty
D330,686 S 11/1992 Campagna
5,276,424 A 1/1994 Hegemann

* cited by examiner

*Primary Examiner*—Stephen Husar
*Assistant Examiner*—Guiyoung Lee

(57) ABSTRACT

A illuminated stop sign for directing motorists to stop. The illuminated stop sign includes a housing. The housing has a front side, a back side and peripheral wall extends between and is integrally coupled to the front and back sides. Each of the front and back sides resembles a stop sign. The housing has a lumen therein. An opening extends into the peripheral wall and into the lumen. The opening is on a bottom edge of the housing. The housing comprises a generally translucent material. An elongate lighting device has a distal end and a proximal end. The proximal end has a light filament therein adapted for emitting a light from the proximal end. The proximal end is adapted for removably coupling to the opening.

3 Claims, 2 Drawing Sheets

ILLUMINATED STOP SIGN

BACKGROUND OF THE INVENTION

1. Field of the Invention

The present invention relates to illuminated sign devices and more particularly pertains to a new illuminated stop sign for directing motorists to stop.

2. Description of the Prior Art

The use of illuminated sign devices is known in the prior art. More specifically, illuminated sign devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,4042,919; U.S. Pat. No. 3,810,091; U.S. Pat. No. 3,279,110; U.S. Pat. No. 1,445,483; U.S. Des. Pat. No. 330,686; and U.S. Pat. No. 5,2176,424.

While these devices fulfill their respective, particular objectives and requirements, the aforementioned patents do not disclose a new illuminated stop sign. The inventive device includes a housing. The housing has a front side, a back side and peripheral wall extends between and is integrally coupled to the front and back sides. Each of the front and back sides resembles a stop sign. The housing has a lumen therein. An opening extends into the peripheral wall and into the lumen. The opening is on a bottom edge of the housing. The housing comprises a generally translucent material. An elongate lighting-device has a distal end and a proximal end. The proximal end has a light filament therein adapted for emitting a light from the proximal end. The proximal end is adapted for removably coupling to the opening.

In these respects, the illuminated stop sign according to the present invention substantially departs from the conventional concepts and designs of the prior art, and in so doing provides an apparatus primarily developed for the purpose of directing motorists to stop.

SUMMARY OF THE INVENTION

In view of the foregoing disadvantages inherent in the known types of illuminated sign devices now present in the prior art, the present invention provides a new illuminated stop sign construction wherein the same can be utilized for directing motorists to stop.

The general purpose of the present invention, which will be described subsequently in greater detail, is to provide a new illuminated stop sign apparatus and method which has many of the advantages of the illuminated sign devices mentioned heretofore and many novel features that result in a new illuminated stop sign which is not anticipated, rendered obvious, suggested, or even implied by any of the prior art illuminated sign devices, either alone or in any combination thereof.

To attain this, the present invention generally comprises a housing. The housing has a front side, a back side and peripheral wall extends between and is integrally coupled to the front and back sides. Each of the front and back sides resembles a stop sign. The housing has a lumen therein. An opening extends into the peripheral wall and into the lumen. The opening is on a bottom edge of the housing. The housing comprises a generally translucent material. An elongate lighting device has a distal end and a proximal end. The proximal end has a light filament therein adapted for emitting a light from the proximal end. The proximal end is adapted for removably coupling to the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that, the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated stop sign apparatus and method which has many of the advantages of the illuminated sign devices mentioned heretofore and many novel features that result in a new illuminated stop sign which is not anticipated, rendered obvious, suggested, or even implied by any of the prior art illuminated sign devices, either alone or in any combination thereof.

It is another object of the present invention to provide a new illuminated stop sign which may be easily and efficiently manufactured and marketed.

It is a further object of the present invention to provide a new illuminated stop sign which is of a durable and reliable construction.

An even further object of the present invention is to provide a new illuminated stop sign which is susceptible of a low cost of manufacture with regard to both materials and labor, and which accordingly is then susceptible of low prices of sale to the consuming public, thereby making such illuminated stop sign economically available to the buying public.

Still yet another object of the present invention is to provide a new illuminated stop sign which provides in the apparatuses and methods of the prior art some of the advantages thereof, while simultaneously overcoming some of the disadvantages normally associated therewith.

Still another object of the present invention is to provide a new illuminated stop sign for directing motorists to stop.

Yet another object of the present invention is to provide a new illuminated stop sign which includes a housing. The housing has a front side, a back side and peripheral wall extends between and is integrally coupled to the front and back sides. Each of the front and back sides resembles a stop sign. The housing has a lumen therein. An opening extends into the peripheral wall and into the lumen. The opening is on a bottom edge of the housing. The housing comprises a generally translucent material. An elongate lighting device has a distal end and a proximal end. The proximal end has a light filament therein adapted for emitting a light from the proximal end. The proximal end is adapted for removably coupling to the opening.

Still yet another object of the present invention is to provide a new illuminated stop sign that is retrofittable to any flashlights.

Even still another object of the present invention is to provide a new illuminated stop sign that is easily portable and may be used stored in a small area in emergency vehicles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
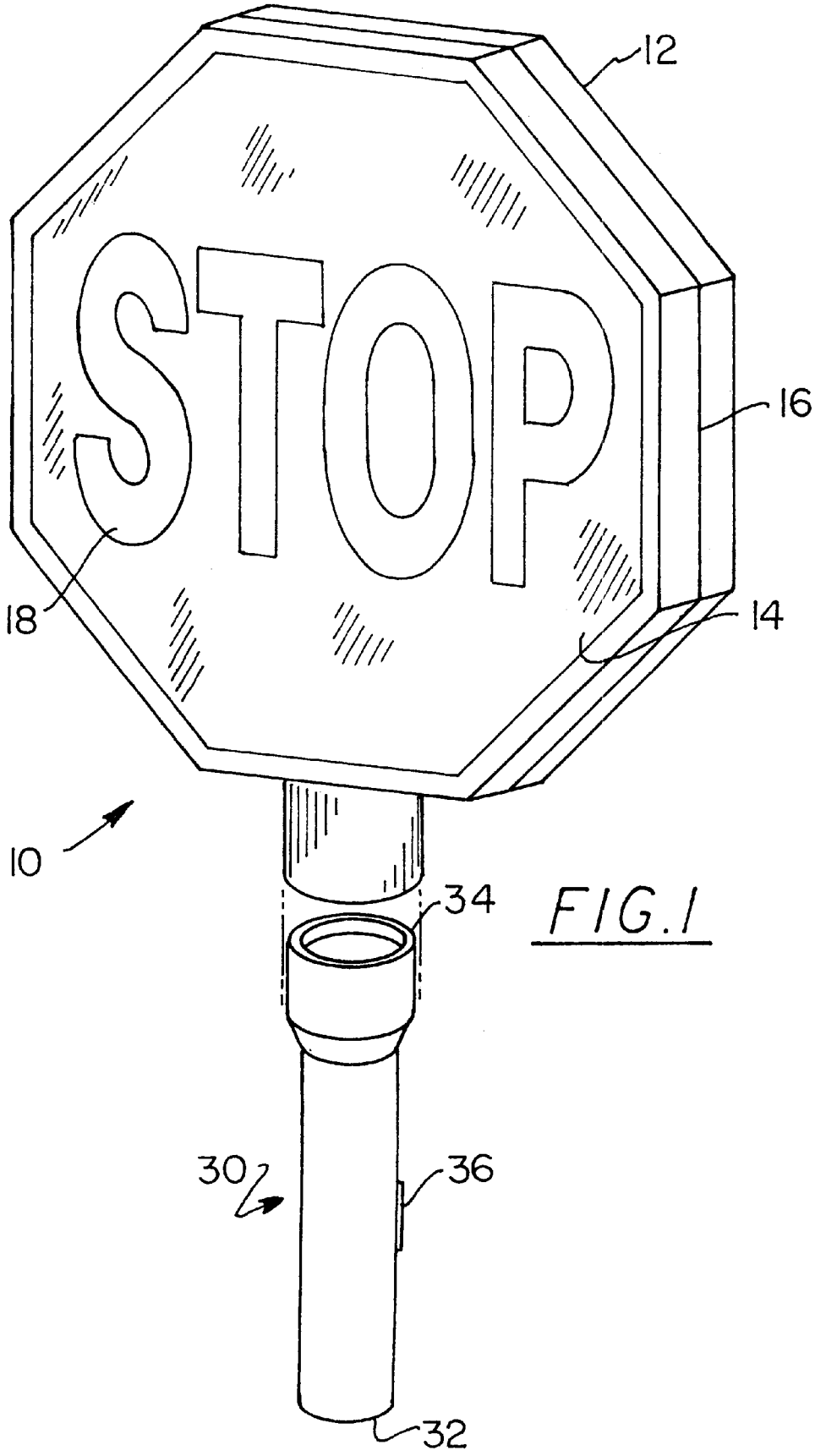
FIG. 1 is a schematic perspective view of a new illuminated stop sign according to the present invention.
Figure 2:
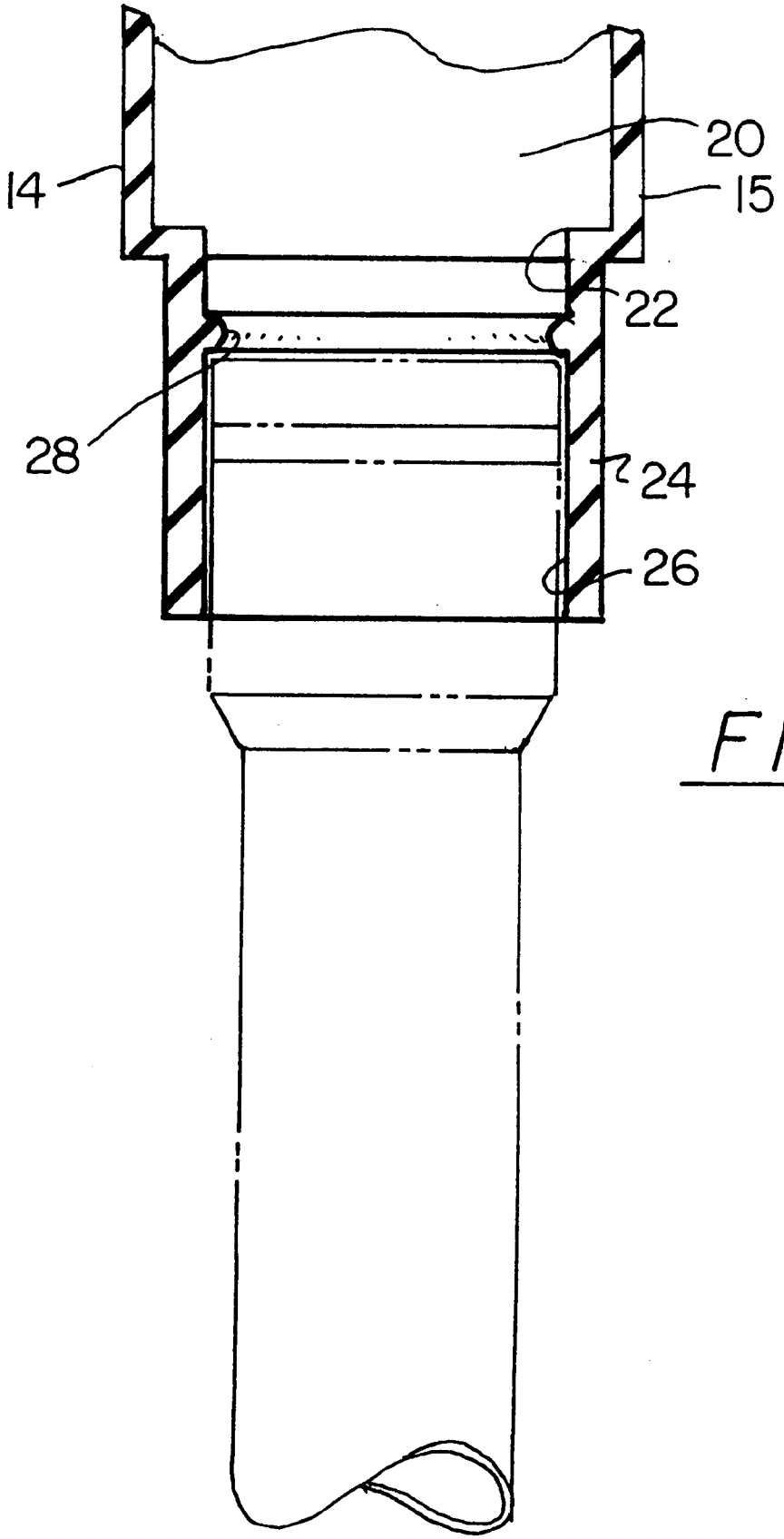
FIG. 2 is a schematic side view of the present invention.

With reference now to the drawings, and in particular to FIGS. 1 and 2 thereof, a new illuminated stop sign embodying the principles and concepts of the present invention and generally designated by the reference numeral 10 will be described.

As best illustrated in FIGS. 1 and 2, the illuminated stop sign 10 generally comprises a housing. The housing 12 has a front side 14, a back side 15 and peripheral wall 16 extending between and integrally coupled to the front and back sides. The front and back sides generally have an octagon shape. The front and back sides each have indicia 18 thereon indicating stop. Each of the front 14 and back sides resembles stop signs. The housing 12 has a lumen 20 therein. An opening 22 extends into the peripheral wall 16 and into the lumen 20. The opening 22 is on a bottom edge of the housing 12. The housing 12 comprises a generally translucent material. The translucent material is ideally colored red. The translucent material preferably comprises a plastic. The housing 12 preferably measures 16 inches long, 16 inches high and 4 inches wide.

A shoulder 24 is securely attached to and extends away from an edge of the opening 22. The shoulder 24 comprises a sleeve. The shoulder 24 ideally comprises an elastomeric material. The shoulder 24 has an inner surface 26. The inner surface 26 has an annular ring 28 integrally coupled thereto. The annular ring 28 is positioned generally adjacent to the opening.

An elongate lighting device 30 has a distal end 32 and a proximal end 34. The proximal end 34 has a light filament, not shown, therein adapted for emitting a light from the proximal end 34. The proximal end 34 has a diameter substantially equal to a diameter of the annular shoulder 24. The proximal end 34 is removably extendable into the shoulder 24 such that the elongate lighting device 30 may illuminate the housing 12. The proximal end 34 is abuttable against the annular ring 28. The elongate lighting device 30 has a power supply, not shown, therein. The power supply is operationally coupled to the light filament. The power supply comprises a battery. An actuating means 36 for turning the light filament on and off is securely attached to the elongate lighting device 30. The actuating means 36 is operationally coupled to the power supply. The elongate lighting device 30 generally comprises a conventional flashlight.

In use, the flashlight 30 is placed in the annular shoulder 24. The elastomeric material holds the flashlight 30 in place so that the light may enter the lumen 20 and illuminate the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated sign device, said device comprising:

a housing having a front side, a back side and peripheral wall extending between and integrally coupled to said front and back sides, each of said front and back sides resembling stop signs, said housing having a lumen therein, an opening extending into said peripheral wall and into said lumen, said opening being on a bottom edge of said housing, said housing comprising a generally translucent material;

an elongate lighting device having a distal end and a proximal end, said elongate lighting device comprising a flashlight wherein light is emitted from said proximal end; and a sleeve being securely attached to and extending away from an edge of said opening, said sleeve comprising an elastomeric material, said proximal end of said flashlight being adapted for removably extending into said sleeve.

2. The illuminated sign device as in claim 1, wherein said sleeve has an inner surface, an annular ring being integrally coupled to said inner surface of said sleeve and being positioned generally adjacent to said opening.

3. An illuminated sign device, said device comprising:

a housing having a front side, a back side and peripheral wall extending between and integrally coupled to said front and back sides, said front and back sides generally having an octagon shape, said front and back sides each having indicia thereon indicating stop, each of said front and back sides resembling stop signs, said housing having a lumen therein, an opening extending into said peripheral wall and into said lumen, said opening being on a bottom edge of said housing, said housing comprising a generally translucent material, said translucent material being colored red, said translucent material comprising a plastic;

a sleeve being securely attached to and extending away from an edge of said opening, said sleeve comprising an elastomeric material, said sleeve having an inner surface, a raised annular ring being integrally coupled thereto, said annular ring being positioned generally adjacent to said opening; and an elongate lighting device having a distal end and a proximal end, said proximal end being removably extendable into said sleeve and being abuttable against said annular ring such that said proximal end does not extend into said housing, said elongate lighting device comprising a flashlight wherein light may be selectively emitted from said proximal end of said flashlight.

* * * * *